US006819548B2

(12) United States Patent
Hillis et al.

(10) Patent No.: US 6,819,548 B2
(45) Date of Patent: Nov. 16, 2004

(54) MODULAR STAND FOR LAPTOP COMPUTER

(75) Inventors: W. Daniel Hillis, Encino, CA (US); Bran Ferren, Beverly Hills, CA (US)

(73) Assignee: Applied Minds, Inc., Glendale, CA (US)

( * ) Notice: Subject to any disclaimer, the term of this patent is extended or adjusted under 35 U.S.C. 154(b) by 0 days.

(21) Appl. No.: 10/245,416

(22) Filed: Sep. 16, 2002

(65) Prior Publication Data

US 2003/0103328 A1 Jun. 5, 2003

Related U.S. Application Data

(63) Continuation-in-part of application No. 09/892,140, filed on Jun. 25, 2001, now abandoned.

(51) Int. Cl.[7] ..... G06F 1/16
(52) U.S. Cl. ..... 361/681; 361/679; 361/683
(58) Field of Search ..... 361/679, 681, 361/683

(56) References Cited

U.S. PATENT DOCUMENTS 5,295,089 A * 3/1994 Ambasz ..... 361/681
6,545,864 B2 * 4/2003 Davis, IV ..... 361/683

OTHER PUBLICATIONS

Meet Oyster; www.sherpaq.com/oyster_home.html.

* cited by examiner

*Primary Examiner*—Yean-Hsi Chang
(74) *Attorney, Agent, or Firm*—Glenn Patent Group; Michael A. Glenn

(57) ABSTRACT

The invention provides a laptop stand that elevates the laptop display such that the display is at a user's eye-level, while at the same time minimizing the amount of desktop space occupied by the laptop computer. The invention provides a stand that holds the laptop computer in an unfolded position such that the laptop's display is elevated to eye-level and facing forward. In particular, the presently preferred embodiment of the invention provides a modular laptop stand that is inexpensive to produce, variously adjustable, and that is substantially flat when not in use, such that it is readily shipped and stored.

13 Claims, 7 Drawing Sheets

MODULAR STAND FOR LAPTOP COMPUTER

CROSS REFERENCE TO RELATED APPLICATIONS

This application is a Continuation-in-Part of U.S. Ser. No. 09/892,140, filed Jun. 25, 2001 now abandoned.

BACKGROUND OF THE INVENTION

1. Technical Field

The invention relates to laptop computers and other portable devices that may include both a display and a data input function. More particularly, the invention relates to a modular stand for such devices.

2. Description of the Prior Art

Laptop computers are becoming popular alternatives to desktop computers. However, the more that laptop computers are made to do the job of desktop computers, the more that their virtues, such as a small form factor and integrated keyboard and display, become liabilities. For example, the user must stare down at the display of the laptop computer while using the keyboard. This becomes fatiguing after more than just casual use.

It is known to provide docking capability for laptop computers and thereby enhance their usability as desktop computers. See, for example, the generic docking station made by Sanyo shown in FIG. 1 (http://www.trycomputing.com/docking.htm). Such a docking station provides the ability to power a laptop and also make external connections to such external facilities as printers and networks.

The Quicklook laptop computer stand, see FIG. 2 (http://www2.acan.net/~quick/laptopstand.html) tilts the laptop to change the laptop keyboard's typing angle. Such a stand, however, is designed with the assumption that the individual using the laptop computer wants to use the laptop's built-in keyboard. Thus, this stand is primarily intended as a mechanism for improving the ergonomics of the laptop's keyboard. Such a stand does not provide an optimal viewing angle for the laptop display because the screen is placed at an angle lower than the user's eye level.

Another example of a laptop stand that may be used to tilt the typing angle of the laptop's built-in keyboard is the Podium CoolPad, shown in FIG. 3 (http://www.roadtools.com/podium.html). Again, the user is required to type on the laptop's built-in keyboard. However, the laptop's built-in display is not elevated such that it is at the user's eye level.

M. Rookruch, P. Blagg, J. Youens, *Space-Saving Docking Station for Vertically Supporting an Open Notebook and Computer*, U.S. Pat. No. 6,208,508 (Mar. 27, 2001) disclose a docking station that supports a notebook computer docked thereto. The '508 patent discloses a type of docking station that provides electrical conductivity through the docking station itself. The docking station is a wedge-like arrangement. Such an arrangement both takes up significant space on a user's desktop, and yet does not elevate the laptop display sufficiently that the display is at the user's eye-level.

See also M. Rookruch, S. Homer, *Vertically Oriented Docking Station Apparatus for Portable Computer*, U.S. Pat. No. 6,185,094 (Feb. 6, 2001) and J. Troyer, *Portable Stand for Laptop Computers*, U.S. Pat. No. 6,076,787 (Jun. 20, 2000).

It would be advantageous to provide a stand for a laptop computer that both supports the laptop computer in a minimal amount of desktop space, while at the same time elevates the laptop computer to a user's eye-level, thereby mitigating the affects of fatigue that are otherwise caused by staring down at the screen of a laptop.

It would be further advantageous to provide a modular laptop stand that is inexpensive to produce, adjustable, and that is substantially flat when not in use, such that it is readily shipped and stored.

SUMMARY OF THE INVENTION

The invention provides a laptop computer stand that elevates the laptop display such that the display is at a user's eye-level, while at the same time minimizing the amount of desktop space occupied by the laptop computer. The invention provides a stand that holds the laptop computer in an unfolded position such that the laptop's display is elevated to eye-level and facing forward. The keyboard and track-pad remain exposed but are most likely not used, an external keyboard and mouse being used instead. This provides the user with the choice of any input device, such as an ergonomic keyboard. Further, this allows the user to position the keyboard away from the display, thereby providing a less fatiguing display-keyboard configuration.

The invention is based upon the recognition that many people use laptop computers on a desktop when in the office, as well as for their intended purpose, i.e. on a laptop. Most people who use laptop computers assume an uncomfortable crouched position when using the laptop on a desktop. Accordingly, a principal benefit of the claimed invention is to elevate the screen of the laptop to a more comfortable level, i.e. eye-level, while at the same time separating the display from the keyboard, thereby allowing the user to position both in a most comfortable configuration.

In other embodiments of the invention the laptop can incorporate a voice recognition software program, e.g. ViaVoice which is manufactured by IBM Corporation of Armonk, N.Y., such that the keyboard is no longer needed. A further benefit of this embodiment invention is that the laptop's microphone is better positioned to capture the user's voice.

In another embodiment of the invention, the laptop is used as a multi-media device such that the display is much better configured to serve as a monitor for displaying video or other multi-media content.

A further benefit of the invention is that the elevation of the computer enhances cooling of the laptop, thereby extending the laptop's useful life.

In particular, the presently preferred embodiment of the invention provides a modular laptop stand that is inexpensive to produce, variously adjustable, and that is substantially flat when not in use, such that it is readily shipped and stored.

DETAILED DESCRIPTION OF THE INVENTION

The invention provides a laptop computer stand that elevates the laptop display such that the display is at a user's eye-level, while at the same time minimizing the amount of desktop space occupied by the laptop computer, and also provides the user with the ability to arrange the orientation of the display and the keyboard (or other data entry device) in a most comfortable configuration.

The invention comprises a stand that holds the laptop computer in an unfolded position such that the display panel is elevated to eye-level and facing forward. The keyboard and track-pad remain exposed but are most likely not used, an external keyboard and mouse being used instead. The invention takes advantage of the recognition that many people use laptop computers on a desktop when in the office, as well as for their intended purpose, i.e. on the lap top. Most people who use laptop computers assume an uncomfortable crouched position when using the laptop on a desktop. Accordingly, a principal benefit of the claimed invention is to elevate the screen of the laptop to a more comfortable level, i.e. eye-level.

A further benefit of the invention is that the elevation of the computer enhances cooling of the laptop by enhancing air circulation about the laptop's case. Additionally, the material of the stand can be made of a heat conductive material that conducts heat away from the laptop computer.

In other embodiments of the invention the laptop can incorporate a voice recognition software program, e.g. ViaVoice manufactured by IBM Corporation of Armonk, N.Y., such that the keyboard is no longer needed. A further benefit of this embodiment invention is that the laptop's microphone is better positioned to capture the user's voice.

In another embodiment of the invention the laptop is used as a multi-media device such that the display is much better configured to serve as a monitor for displaying video or other multi-media content.

Figure 1:
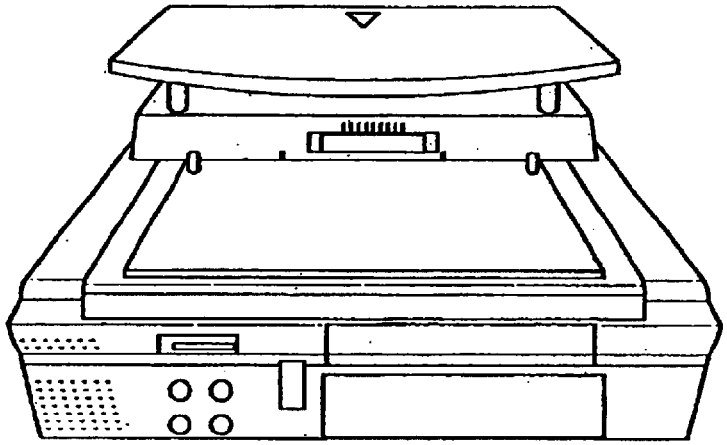
FIG. 1 (Prior Art)
FIG. 1 is a perspective view of a laptop computer docking station.
Figure 2:
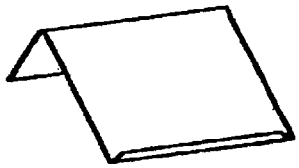
FIG. 2 (Prior Art)
FIG. 2 is a perspective view of a laptop stand.
Figure 3:
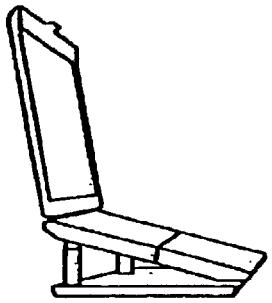
FIG. 3 (Prior Art)
FIG. 3 is a perspective view of a second laptop stand.
Figure 4:
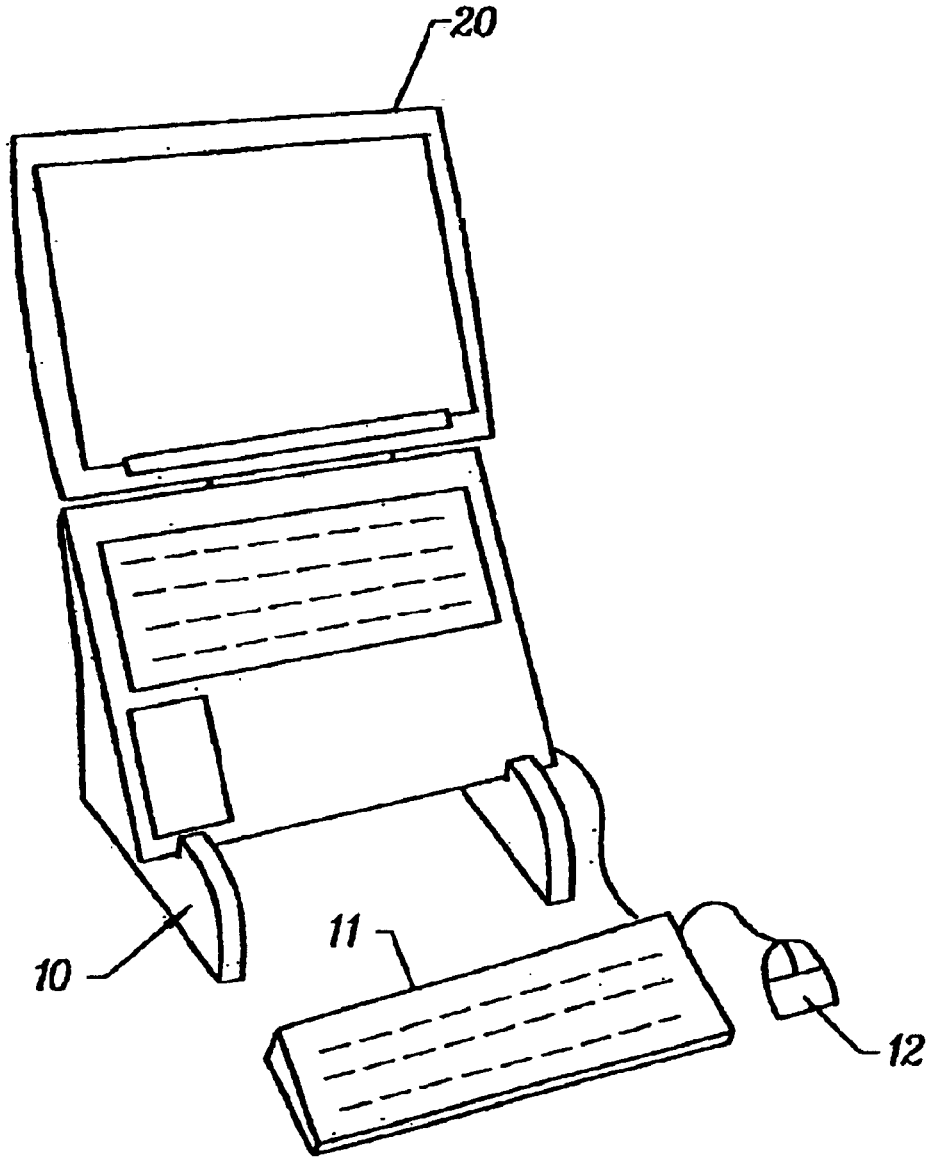
FIG. 4 is a perspective view of a laptop stand according to the invention showing the stand holding a laptop in an open configuration.

The presently preferred embodiment of the invention provides a stand that holds a laptop computer in an unfolded position where the display portion of the laptop is elevated to eye-level and facing forward. In FIG. 4, a laptop 20 is shown resting on a stand 10. Also shown in FIG. 4 are a keyboard 11 and a mouse 12. While it is anticipated that the invention will be used in this format, it is likely that voice recognition software may be used in some embodiments of the invention, such that a keyboard and mouse are not needed. Further, it is anticipated that the invention may be used as a multi-media device, in which case a keyboard or mouse would also not be needed.

Figure 5:
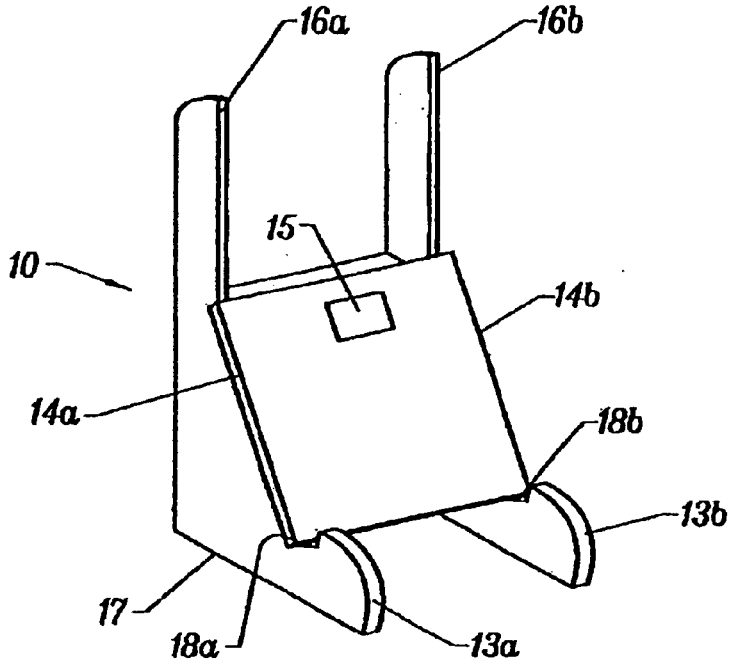
FIG. 5 is a right perspective view of the laptop stand according to the invention.

FIG. 5 is a perspective view of a preferred embodiment of the invention. In FIG. 5, the stand 10 is shown including a base portion 17 having two substantially parallel, outwardly projecting legs 13A/13B which provide both support for the stand and which define retaining notches 18A/18B. More than one set of notches may be provided, such that the elevation of the display may be raised or lowered by setting a bottom portion of the laptop computer into notches at a rear portion of the base to raise the display or at a front portion of the base to lower the display.

In other embodiments of the invention, the laptop may be retained by a stop mounted to one or both legs of the stand, by hooks, or by a strap, or any other retaining mechanism. Further, the legs may be replaced by a solid base, e.g. a sheet of acrylic material.

The stand has an inclined portion defined by end-rails 14A/14B against which the lower portion of the laptop rests. In other embodiments of the invention, the inclined portion is not provided. Rather, it is only necessary that the laptop be securely retained in a vertical or near vertical orientation, such that the laptop's display is elevated to user eye-level. Thus, while the preferred embodiment of the invention relies upon a combination of the retaining notches and gravity, i.e. the incline, to secure the laptop in a vertical elevation, other embodiments of the invention may provide an L-shaped configuration that effects the same retention as the preferred embodiment, but without the actual incline, or the laptop may be secured in a vertical orientation, for example, by hooks or straps as discussed above. In still other embodiments of the invention, it may be desirable to provide an adjustable support (not shown), such that the back of the laptop display is prevented from falling backward. Such support may be adjustable. Further, such support may include a notched upper portion that extends from the back of the laptop computer display towards the front to secure the display against unwanted movement.

An aperture 15 is defined within the stand through which cables may be routed. In alternative embodiments of the invention, a connector or series of connectors may be provided instead of, or in addition to, the aperture, such that the laptop may be electrically docked to a power supply, network connection, and other such external connections Thus, the aperture 15 may include a set of docking connections to which the laptop may be docked thereby eliminating the need to run wires to the laptop. The aperture 15 may also be configured to allow air to flow behind the laptop to aid in cooling the laptop.

A pair of upwardly projecting members 16A/16B further define a support for the laptop. It should be noted that in various embodiments of the invention the construction need not be of solid members as shown in FIG. 5, but may be made of tubes, rods, clear plastic, and other materials that provide the generally shown supporting structure of FIG. 5.

Further, it should be appreciated that the various elements shown in FIG. 5 can be made adjustable. For example, the supporting members 16A/16B may be telescoped to accommodate different sized displays, and may also be articulated to provide various levels of tilt as desired.

Also, the notches can be brackets that retain the lower portion of the laptop (the keyboard portion) such that a smaller footprint may be provided.

Additionally, the legs 13A/13B may be articulated relative to the upwardly projecting member 16A/16B, such that the support angle for the laptop may be adjusted at the base 17.

Additionally, the retaining notches 18A/18B may slide along the track, in which case the height of the display may be adjusted.

The height of the display may also be adjusted by providing telescopic feet from the base 17.

Figure 6:
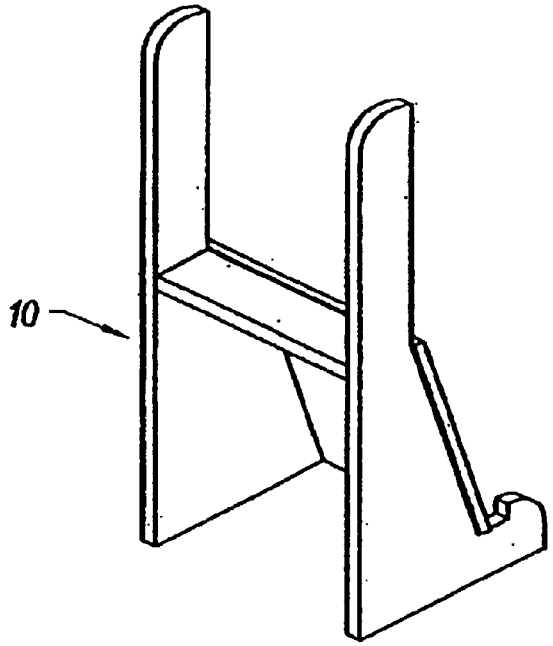
FIG. 6 is a right rear perspective view of a laptop stand according to the invention.

FIG. 6 is a rear perspective view showing a laptop stand according to the invention. As discussed above the particular structure depicted herein is shown for purposes of example only. While the laptop stand is made from solid materials, such as wood, plastic, or metal, it can just as readily be made from tubular materials, rods, grills, etc.

Further, while a particular cross support structure is shown, it will be appreciated that other support structures can also be shown. Additionally, the stand or support structures can be designed to maximize convective cooling of the laptop. Key to the invention is the ability to retain a base portion of the laptop in an elevated position such that the display portion of the laptop is raised to a user's eye-level.

Figure 7:
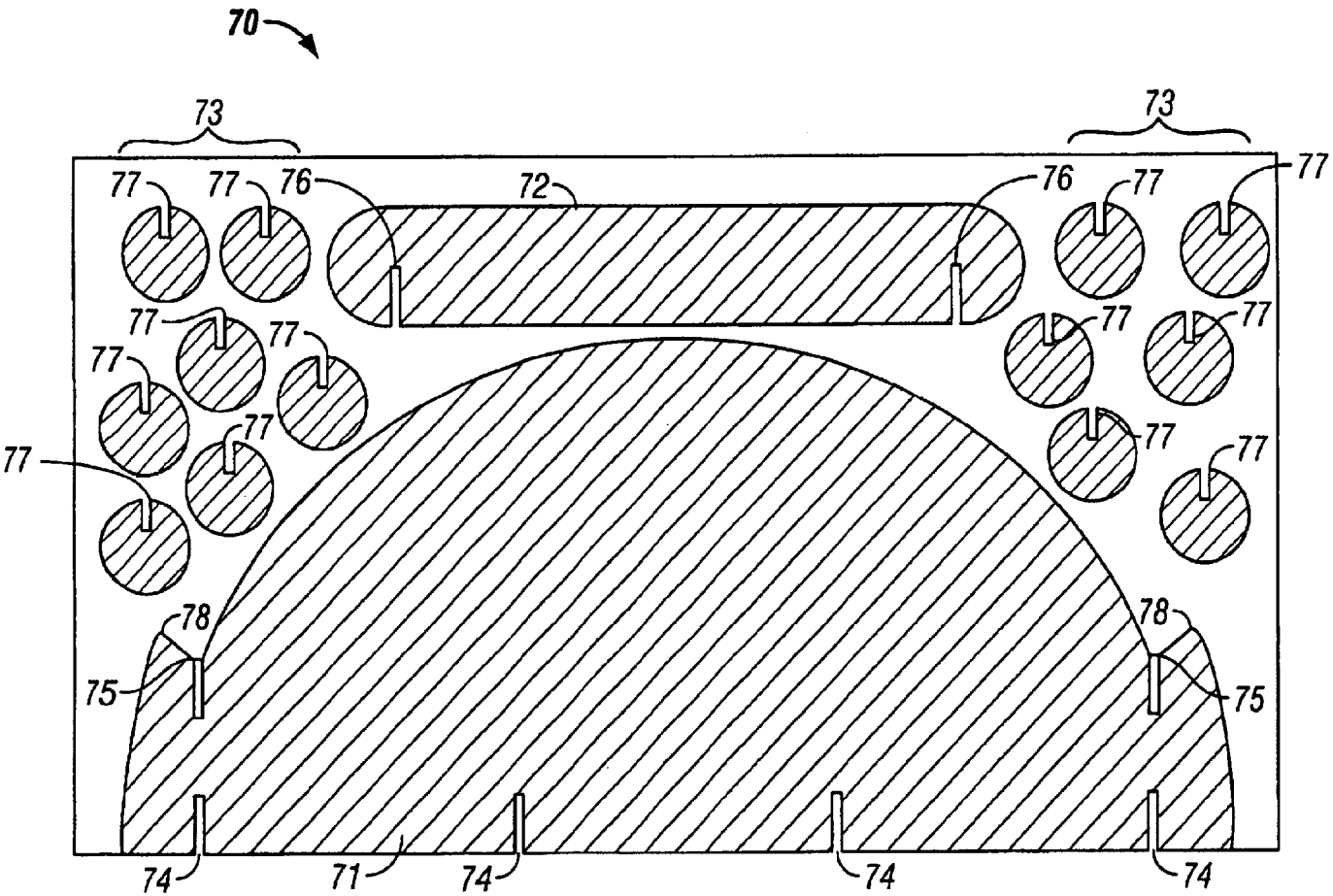
FIG. 7 is a plan view of a modular laptop stand in an unassembled form according to the invention.

A further embodiment of the invention provides a modular laptop stand that is inexpensive to produce, variously adjustable, and that is substantially flat when not in use, such that is readily shipped and stored. FIG. 7 is a plan view of a modular laptop stand according to this embodiment of the invention shown in unassembled form. In FIG. 7, the modular laptop stand is shown as a collection of elements that are formed in a single stamped sheet 70. In this embodiment of the invention, the sheet may be any rigid, yet flexible material such as foam core, acrylic or other plastic, cardboard, hard rubber, sheet metal, or other such material. The actual choice of material is not critical, provided that the material is of sufficient rigidity to support a laptop computer when the stand is assembled (as discussed below) and is sufficiently flexible to allow the stand to be assembled.

A key feature of the invention is the modularity of the stand. In the example shown in FIG. 7, a set of die is used to stamp each piece of the laptop stand in the sheet material. This allows the laptop stand to be produced at a very low cost, such that it may be sold for minimal cost, or given away as a promotional item. Further, because the modular laptop stand is formed from a single sheet, it is readily packed for travel, which is consistent with the use to which a laptop is put, i.e. travel. As such, the components of the laptop stand may be provided in a small sleeve or box having portions or recesses to receive the various pieces of a modular laptop stand. Alternatively, the laptop stand may be provided on a perforated sheet, such that it may be punched out by the user, when it is to be used. In such case, the sheet from which the pieces are punched may be provided with a backing, such that the sheet becomes a carrying case for the components of the laptop stand when the stand is not in use.

The elements of the laptop stand shown in FIG. 7 include a base 71 having apertures or slots 74 formed therethrough for receiving support elements, 73 through mating engagement with apertures or slots 77 formed in the support elements; additional apertures or slots 75 formed therein for mating engagement with apertures or slots 76 of a brace 72; and a notch 78, which provides a rest and stop for the laptop (see FIG. 8, discussed below).

Figure 8:
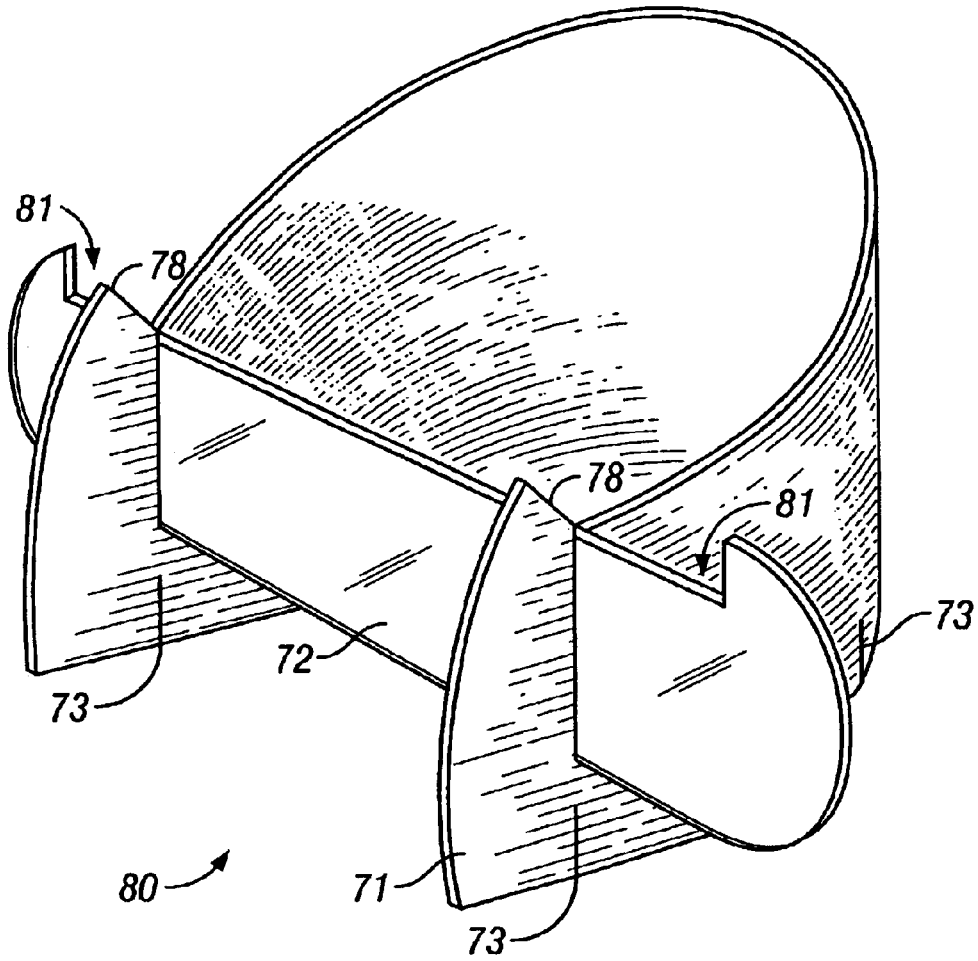
FIG. 8 is a perspective view of a modular laptop stand in an assembled form according to the invention.

FIG. 8 is a perspective view of modular laptop stand in an assembled form according to the invention. In FIG. 8, the base 71 is formed in the shape of an arch and held in position by mating engagement of the stand apertures or slots 75 with the aperture or slot 76 of the base 72. It can be seen that the stand is supported by a plurality of support elements 73 which have apertures or slots 77 that matingly engage with apertures or slots 74 formed within the base 71. In some embodiments of the invention, the laptop stand may be provided without such support elements. In other embodiments of the invention, an assortment of support elements may be provided, such that the laptop stand may be supported at various heights as determined by the size of a particular support element, in accordance with user preference.

Further, the brace 72 may be provided with a plurality of apertures or slots formed therein such that the location of engagement of the base along the length of the brace may be varied to affect the angle at which the laptop is supported.

As seen in FIG. 8, the notches 78 provide a surface against which the laptop is retained when in use. Further notches 81 may be provided as a cutout in the brace to define a depression which prevents sideways motion of the laptop while it is retained in the stand.

In an alternate embodiment of the invention, the base may include an extruded member (not shown) which engages along the perimeter of the base to affect the height of a stand. Further, the extrusion may include a receptacle portion both on an upper surface for engagement with the base, and a receptacle portion on a lower surface, into which an extender may be inserted to raise the height of the stand as desired.

It is further noted that this embodiment of the invention provides an open design that allows cables to be drawn out from underneath the base portion. In this regard, an opening may be formed in the back of the base to route the cables from behind the base.

Finally, while this embodiment of the invention is discussed as being formed from a single sheet, those skilled in the art will appreciate that the various elements of this embodiment of the invention may be formed independently. Thus, the base may comprise a flexible member, while the brace may be formed of a different, more rigid material, such as an acrylic or polycarbonate material. Further, while support members are shown as providing support and lift for the stand, notched balls, knobs, dowels, or other support mechanisms could be provided instead of, or in addition to, the support elements shown in FIGS. 7 and 8.

Given the ease and minimal expense required to manufacture this invention, it is anticipated that this invention will find various promotional uses. Therefore, it is anticipated that the stand may be stamped with company logos or other promotional information and handed out in un-punched form, for example at various convention or tradeshows.

Figure 9:
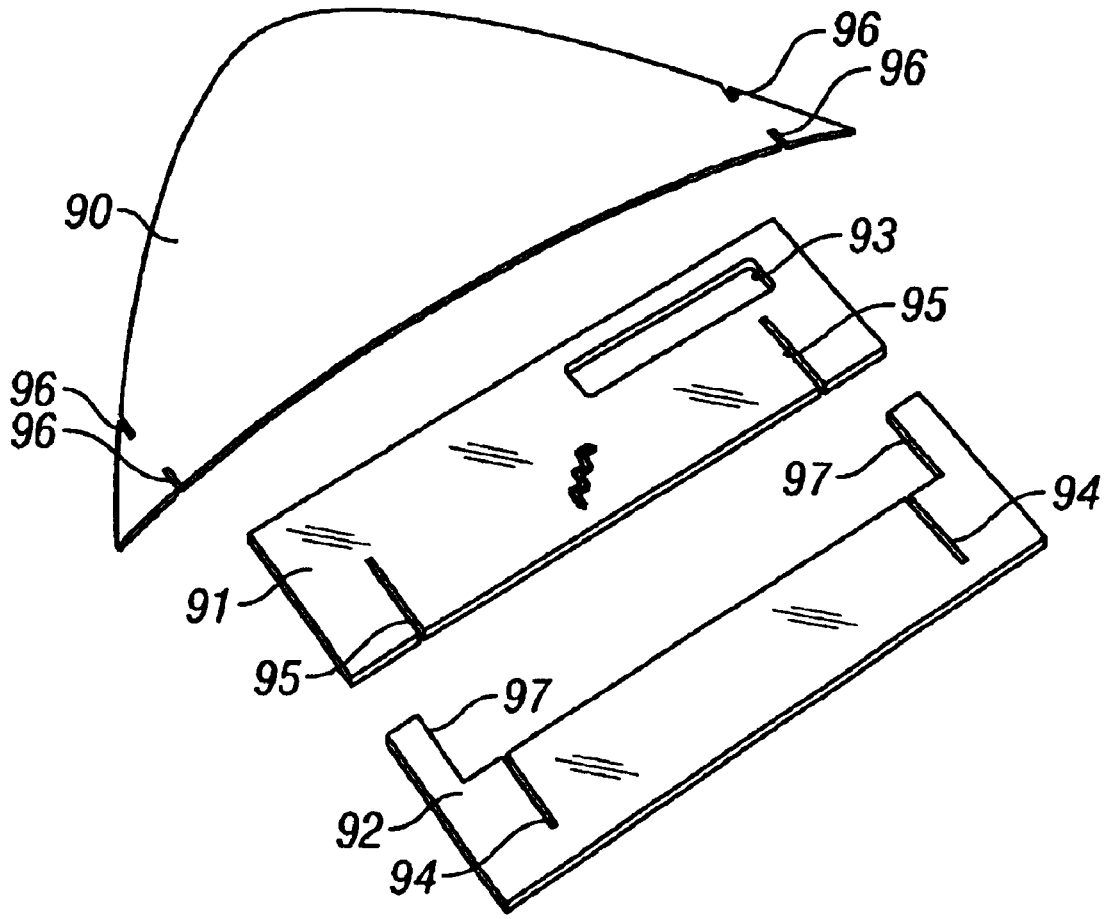
FIG. 9 is a plan view of a modular laptop stand in an unassembled form according to an alternative embodiment of the invention.
Figure 10:
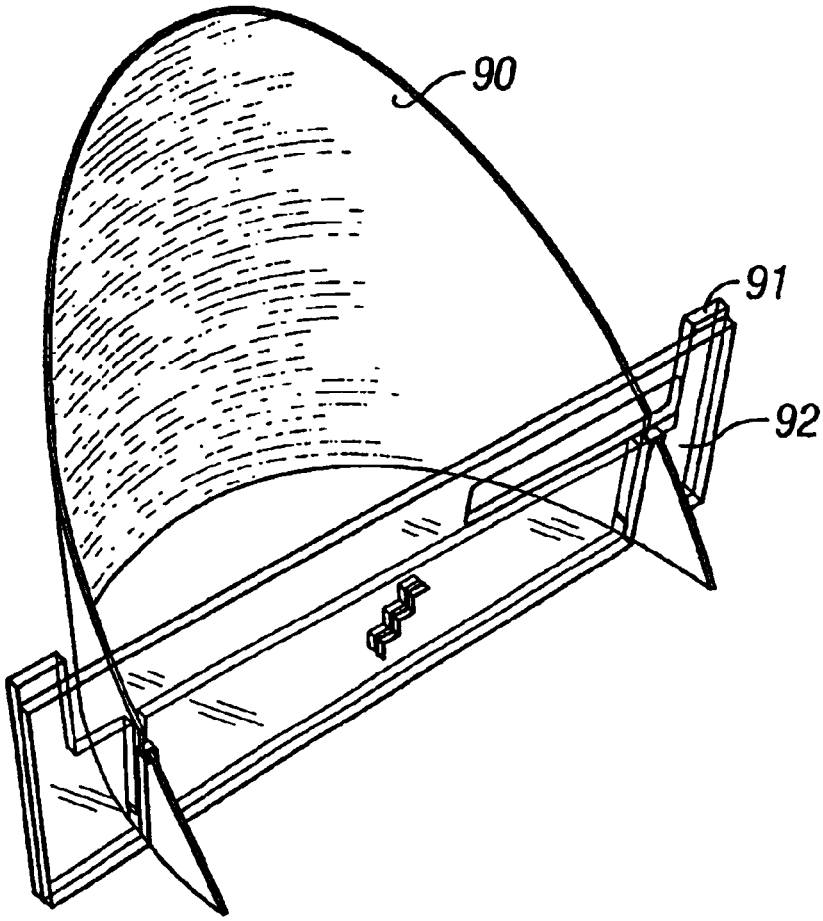
FIG. 10 is a perspective view of a modular laptop stand in an assembled form according to the alternative embodiment of the invention.

FIG. 9 is a plan view of a modular laptop stand in an unassembled form according to an alternative embodiment of the invention; and FIG. 10 is a perspective view of a modular laptop stand in an assembled form according to the alternative embodiment of the invention. In FIG. 10, the base 90 is formed of a flexible or resilient material in the shape of an arch and held in position by mating engagement of the substantially rigid compound brace/support 91, 92 apertures or slots 93, 94 with the apertures or slots 96 of the base 90. Further, the opposed nature of the compound brace/support engages slots in the base from the bottom and engages slots in the base from the top. This is key to providing rigidity to the structure.

Further, the compound brace/support 91, 92 may be provided with one or more apertures or slots 93 formed therein to process a passage port for a keyboard and/or mouse cable.

As seen in FIG. 8, the notches 97 formed in one of the brace/support members 92 provide a surface against which the laptop is retained when in use.

Although the invention is described herein with reference to the preferred embodiment, one skilled in the art will readily appreciate that other applications may be substituted for those set forth herein without departing from the spirit and scope of the present invention. For example, slots may be provided that are designed to facilitate the operation of devices onboard the laptop, such as DVD's, etc. For example, a slot may be provided that allows the DVD tray on a laptop to open.

Accordingly, the invention should only be limited by the claims included below.

What is claimed is:

1. A stand for supporting a laptop computer in a substantially unfolded configuration, said laptop computer having a display, said stand comprising:

a substantially flat base member that is flexible into a curved configuration for supporting said laptop computer; and at least one brace member, engageable with said substantially flat base member for retaining said substantially flat base member in said curved configuration;

wherein said substantially flat base member comprises one or more support elements, any of said support elements and said substantially flat base member comprising one or more retaining apertures or slots for fixedly engaging said support elements and said substantially flat base member; and wherein said laptop computer display is positioned at a user's eye-level.

2. A stand for supporting a laptop computer in a substantially unfolded configuration, comprising:

a substantially flat base member that is flexible into a curved configuration for supporting said laptop computer; and at least one brace member, engageable with said substantially flat base member for retaining said substantially flat base member in said curved configuration;

wherein said laptop computer display is positioned at a user's eye-level; and wherein said substantially flat base member comprises an inclined portion defined by apertures or slots against which a lower portion of said laptop rests.

3. A stand for supporting a laptop computer in a substantially unfolded configuration, comprising:

a substantially flat base member that is flexible into a curved configuration for supporting said laptop computer; and at least one brace member, engageable with said substantially flat base member for retaining said substantially flat base member in said curved configuration, said at least one brace member comprising a depression defined by one or more tabs for retaining a lower portion of said laptop against sideways movement;

wherein said laptop computer display is positioned at a user's eye-level.

4. A stand for supporting a laptop computer in a substantially unfolded configuration, said laptop computer having a display, said stand comprising:

a substantially flat base member that is flexible into a curved configuration for supporting said laptop computer; and at least one brace member, engageable with said substantially flat base member for retaining said substantially flat base member in said curved configuration;

wherein said laptop computer display is positioned at a user's eye-level; and wherein an aperture or slot is defined by said substantially flat base member and is configured to allow air to flow behind said laptop computer to aid in cooling said laptop computer.

5. A stand for supporting a laptop computer in a substantially unfolded configuration, said laptop computer having a display, said stand comprising:

a substantially flat base member that is flexible into a curved configuration for supporting said laptop computer; and at least one brace member, engageable with said substantially flat base member for retaining said substantially flat base member in said curved configuration;

wherein said laptop computer display is positioned at a user's eye-level; and wherein a plurality of spaced, transverse apertures or slots are formed in said at least one brace member for selective engagement with complementary apertures or slots formed in said substantially flat base member to retain said substantially flat base member in said curved configuration when said spaced, transverse brace apertures or slots are engaged with said complementary base member apertures or slots.

6. The stand of claim 5, wherein said spaced, transverse brace member apertures or slots allow a selected amount of curve in said substantially flat base member.

7. A stand for supporting a laptop computer in a substantially unfolded configuration, said laptop computer having a display, said stand comprising:

a substantially flat base member that is flexible into a curved configuration for supporting said laptop computer, said substantially flat base member comprising one or more support elements; and at least one brace member, engageable with said substantially flat base member for retaining said substantially flat base member in said curved configuration;

wherein said laptop computer display is positioned at a user's eye-level; and wherein said stand height is adjusted by the size of said support elements.

8. A stand for supporting a laptop computer in a substantially unfolded configuration, said laptop computer having a display, said stand comprising:

a substantially flat base member that is flexible into a curved configuration for supporting said laptop computer; and at least one brace member, engageable with said substantially flat base member for retaining said substantially flat base member in said curved configuration;

wherein said laptop computer display is positioned at a user's eye-level; and wherein either said substantially flat base member and said at least one brace member is made of a heat conductive material that conducts heat away from said laptop computer.

9. A stand for supporting a laptop computer in a substantially unfolded configuration, said laptop computer having a display, said stand comprising:

a substantially flat base member that is flexible into a curved configuration for supporting said laptop computer; and at least one brace member, engageable with said substantially flat base member for retaining said substantially flat base member in said curved configuration;

wherein said laptop computer display is positioned at a user's eye-level; and wherein said stand is designed to maximize convective cooling of said laptop computer.

10. A stand for supporting a laptop computer in a substantially unfolded configuration, said laptop computer having a display, said stand comprising:

a substantially flat base member that is flexible into a curved configuration for supporting said laptop computer; and at least one brace member engageable with said substantially flat base member for retaining said substantially flat base member in said curved configuration;

an extension member having a first mating portion for engagement with a bottom portion of said substantially flat base member and having a second mating portion; and a support member for engagement with said extension member secured mating portion to raise said stand by an amount substantially equal to the width of said support member;

wherein said laptop computer display is positioned at a user's eye-level.

11. A stand for a foldable electronic device that incorporates both a display and a data entry mechanism, said stand supporting said foldable electronic device in a substantially unfolded configuration, said stand comprising:

a flexible base member for supporting said foldable electronic device when said base member is flexed into a curved configuration; and at least one support member which, when integrated with or attached to said flexible base member secures said flexible base member in said curved configuration;

wherein said display is positioned at a user's eye-level; and wherein said stand is made of a heat conductive material that conducts heat away from said electronic device.

12. A stand for a foldable electronic device that incorporates both a display and a data entry mechanism, said stand supporting said foldable electronic device in a substantially unfolded configuration, said stand comprising:

a flexible base member for supporting said foldable electronic device when said base member is flexed into a curved configuration; and at least on support member which, when integrated with or attached to said flexible base member secures said flexible base member in said curved configuration;

wherein said display is positioned at a user's eye-level; and wherein said stand or said at least one support member is designed to maximize convective cooling of said electronic device.

13. A stand for a foldable electronic device that incorporates both a display and a data entry mechanism, said stand supporting said foldable electronic device in a substantially unfolded configuration, said stand comprising:

a flexible base member for supporting said foldable electronic device when said base member is flexed into a curved configuration; and a plurality of support members which, when integrated with or attached to said flexible base member secures said flexible base member in said curved configuration;

wherein said display is positioned at a user's eye-level; and wherein one of said support members comprises slots which engage with slots formed in said flexible base member from a bottom of said flexible base member; and wherein another of said support members comprises slots which engage with slots formed in said flexible base member from a top of said flexible base member.

* * * * *